United States Patent [19]

Everson

[11] 4,131,210

[45] Dec. 26, 1978

[54] BACKHOE JAW ATTACHMENT

[76] Inventor: Clifford G. Everson, 1814 E. 8th St., Olympia, Wash. 98501

[21] Appl. No.: 772,343

[22] Filed: Feb. 25, 1977

[51] Int. Cl.[2] ..... B66C 1/22

[52] U.S. Cl. ..... 214/147 G; 294/104

[58] Field of Search ..... 214/147 G, 147 T, 147 R, 214/1 BD; 294/104, 67 BC

[56] References Cited

U.S. PATENT DOCUMENTS

| | | | |
|---|---|---|---|
| 3,300,242 | 1/1967 | Renfroe | 294/104 |
| 3,455,477 | 7/1969 | Blair | 214/147 R X |
| 3,737,059 | 6/1973 | Peterson | 214/147 R X |
| 3,802,731 | 4/1974 | Bounty | 214/147 G X |

FOREIGN PATENT DOCUMENTS

| | | | |
|---|---|---|---|
| 1522225 | 3/1968 | France | 294/104 |
| 307832 | 1/1969 | Sweden | 214/147 G |

*Primary Examiner*—Albert J. Makay
*Assistant Examiner*—George F. Abraham
*Attorney, Agent, or Firm*—Clarence A. O'Brien; Harvey B. Jacobson

[57] ABSTRACT

A jaw attachment for a backhoe has a first jaw affixed to the dipper stick of the backhoe and a second jaw pivotally mounted on the dipper stick such that a gripping portion of the second jaw is movable toward and away from a mating gripping portion of the first jaw. The fluid motor mounted on the dipper stick and normally connected to the usual bucket of a backhoe is connected to the second jaw for actuating same. The configuration of the gripping portions of the jaws can be varied in order to accommodate articles of different configurations, such as timbers, pipes, brush, and the like.

4 Claims, 7 Drawing Figures

BACKHOE JAW ATTACHMENT

BACKGROUND OF THE INVENTION

1. Field of the Invention

This invention relates generally to a gripping device, and particularly to a jaw attachment for a backhoe.

2. Description of the Prior Art

Various devices have been proposed which are mountable on the dipper stick of a conventional backhoe in order to increase the versatility of the equipment. As is well known, backhoes employ a pair of articulated arms generally referred to as the mast or boom and the dipper stick in order to achieve implement movements unattainable with other earthworking machines. By providing various attachments for the outer or free end of the dipper stick, either to supplement or replace the bucket conventionally provided on a backhoe, not only the usual particulate or loose material can be readily handled with a backhoe, but solid objects such as logs, railroad ties, pipes, brush, and the like, can be handled in a simple and efficient manner.

An example of a jaw attachment for a backhoe can be found in U.S. Pat. No. 3,273,729, issued September 20, 1966, to V. J. Holopainen. Further, U.S. Pat. No. 3,807,589, issued April 30, 1974, to R. C. Shovick, discloses the use of an auxiliary bucket affixed to the dipper stick of a backhoe in order to cooperate with the usual movable backhoe bucket and permit gripping of boulders and similar large objects.

Other appropriate examples of attachments for backhoes can be found in U.S. Pat. Nos: 3,143,227, issued August 4, 1964, to E. R. Wiemann; 3,275,172, issued September 27, 1966, to W. J. Smith; 3,353,285, issued November 21, 1967, to D. W. Murray; 3,613,922, issued October 19, 1971, to H. C. Clark; and 3,777,918, issued December 11, 1973, to C. L. Barber; and also in Norwegian patent No. 105,490, issued January 25, 1965, to Stiansen. In addition, other pertinent attachments for earthworking devices other than backhoes can be found in U.S. Pat. Nos: 1,773,478, issued August 19, 1930, to J. P. Dovel; 2,639,826, issued May 26, 1953, to D. P. Welden; 2,908,409, issued October 13, 1959, to H. R. Hinders, et al.; and 3,263,838, issued August 2, 1966, to K. O. G. Herolf.

SUMMARY OF THE INVENTION

It is an object of the present invention to provide a jaw attachment for use with backhoes which is simple and inexpensive of construction, yet rugged and reliable of operation when compared with conventional jaw attachments for the same purpose.

It is another object of the present invention to provide a jaw attachment for use with backhoes, and the like, which is adjustable in a simple manner, yet does not require additional fluid motors other than those conventionally provided with a backhoe.

These and other objects are achieved according to the present invention by providing a jaw attachment having: a first jaw affixed to the dipper stick of a backhoe; and a second jaw pivotally mounted on the dipper stick of the backhoe for movement toward and away from the first jaw. More specifically, the second jaw is connected to a fluid motor conventionally associated with the dipper stick, such that a gripping portion of the second jaw is afforded swinging movement by means of the fluid motor toward and away from a cooperating gripping portion of the first jaw.

The first jaw includes a first pin for mounting the first jaw on the dipper stick, and is provided with a plurality of holes arranged for alternatively receiving the first pin. This plurality of holes permits adjustment of the angle of the first jaw relative to the dipper stick. The first jaw further includes a second pin for pivotally mounting the second jaw on the first jaw, and for affixing the first jaw on the dipper stick in cooperation with the first pin. Thus, the first jaw is affixed to the dipper stick in a manner so as to be easily removable, while the second jaw is mounted for pivotal movement of one of the two pins which affixes the first jaw to the dipper stick.

The first jaw and second jaw each advantageously include a pair of spaced, substantially parallel plates, with the second jaw including a third pin facilitating attachment of the second jaw to the fluid motor associated with the dipper stick.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 2:
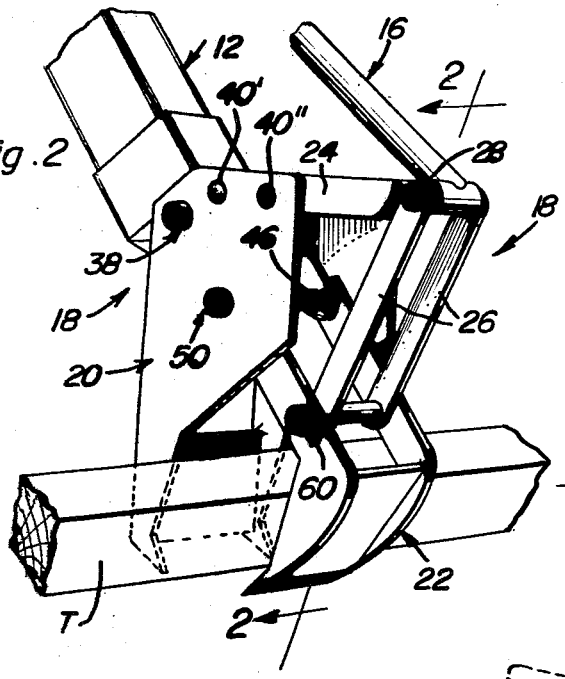
FIG. 2 is an enlarged, fragmentary, perspective view showing the jaw attachment according to the invention.
Figure 1:
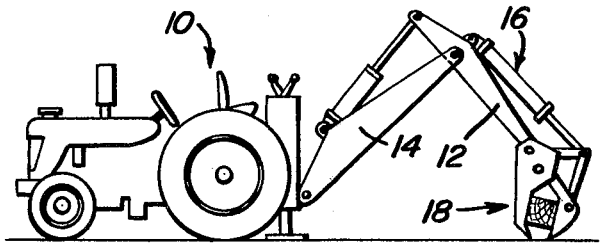
FIG. 1 is a schematic, side elevational view, showing a backhoe provided with a jaw attachment according to the present invention.
Figure 3:
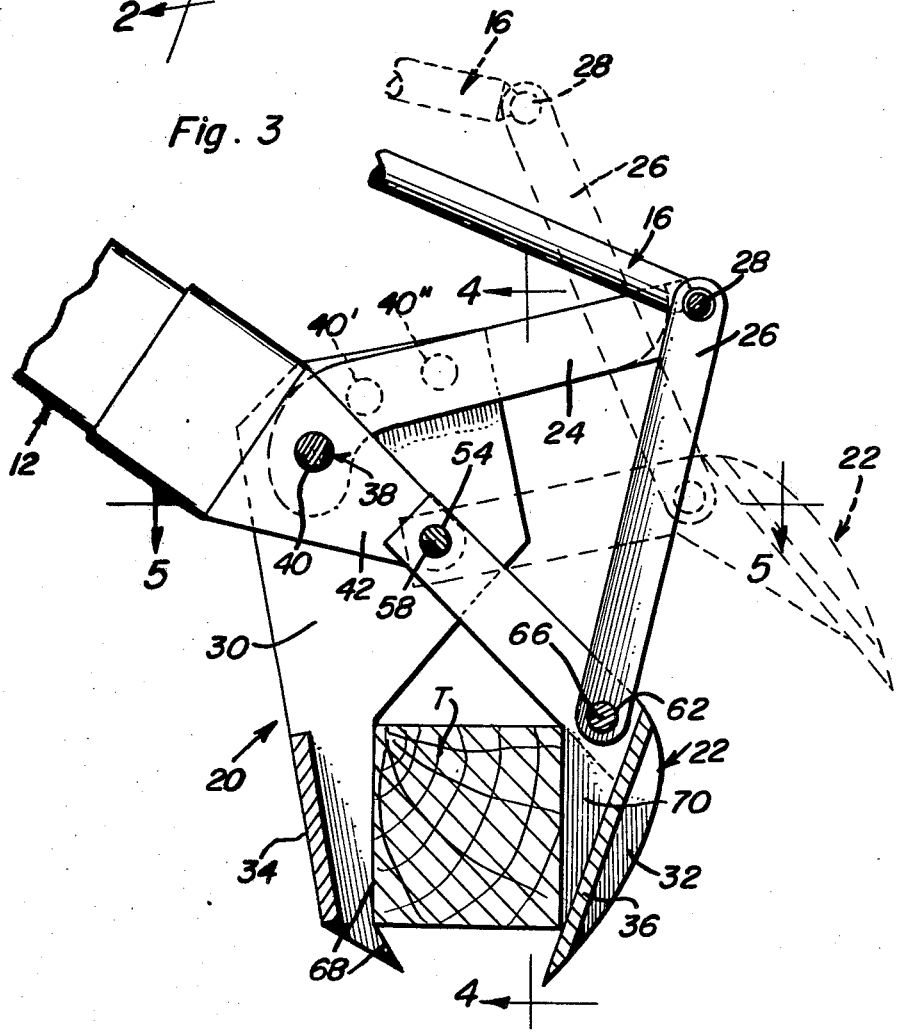
FIG. 3 is an enlarged, fragmentary, sectional view taken generally along the line 3—3 of FIG. 2.
Figure 4:
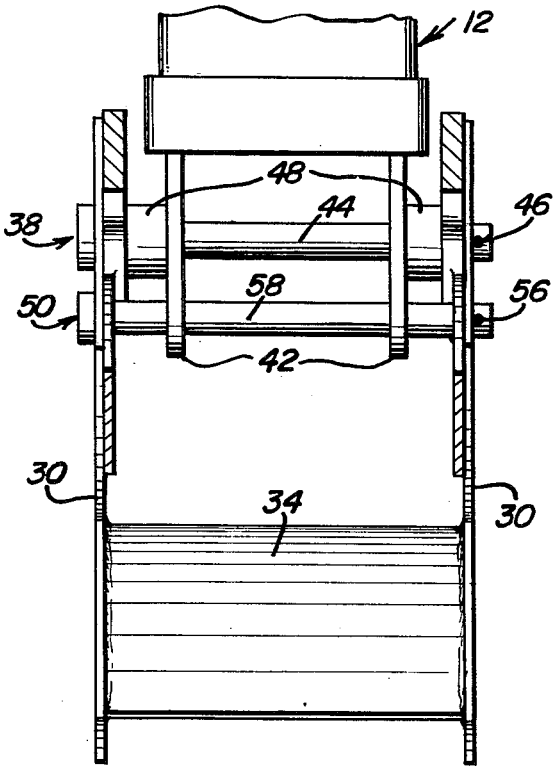
FIG. 4 is a fragmentary, sectional view taken generally along the line 4—4 of FIG. 3.
Figure 5:
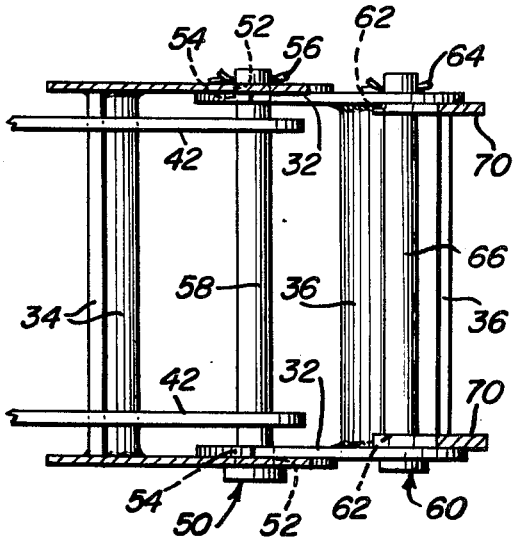
FIG. 5 is a fragmentary, sectional view taken generally along the line 5—5 of FIG. 3, but with one of the jaw attachment pins removed.

Referring now more particularly to FIGS. 1 through 5 of the drawings, a backhoe 10 of generally conventional construction includes a dipper stick articulated to a boom or mast 14 pivotally mounted on the tractor portion of backhoe 10. Further, a conventional linear fluid motor 16 is pivotally mounted on the dipper stick 12 adjacent the point of pivotal mounting thereof to boom or mast 14 as is conventional, and this motor 16 is illustrated as connected to a jaw attachment 18 according to the present invention.

Jaw attachment 18 includes a first jaw 20 affixed to dipper stick 12 of backhoe 10, and a second jaw 22 pivotally mounted on dipper stick 12 for movement toward and away from first jaw 20. A pair of links 24 and 26 extend from a common pivot defined by a pin 28 attached to the free end of the piston rod of fluid motor 16 in order to attach fluid motor 16 to the jaws 20 and 22. By this arrangement, it can be seen that reciprocating movement of fluid motor 16 will cause a similar shift in the location of the pivot axis formed by pin 28 and, accordingly, second jaw 22 will be swung from a gripping position as shown by full lines in FIG. 3 to the, for example, position shown by the broken lines also in FIG. 3.

Both first jaw 20 and second jaw 22 each include a pair of spaced, substantially parallel plates 30 and 32, respectively, with the plates 30 being connected together in spaced relation by a panel 34, and the plates 32 being connected in spaced relation by a panel 36 similar to panel 34. By this arrangement, it will be appreciated that the jaws 20 and 22 are formed as rigid, self-supporting assemblies attachable to the dipper stick 12 of a backhoe 10 as a unit.

Jaw 20 includes a first pin 38 arranged for mounting jaw 20 on dipper stick 12 by extending through one of the pairs of holes 40, 40' and 40", provided in the plates 30 of jaw 20, and passing through mating holes provided in the pair of substantially parallel tongues 42 extending from the free end of dipper stick 12 so as to receive shank 44 of pin 38. The latter is retained within the respective pairs of holes 40, 40' and 40", and the holes provided in the tongues 42, as by convention cotter pin 46. Spacers 48 may be provided between plates 30 and tongues 42, if desired, in order to maintain the proper spacing between these elements. As will be appreciated, the plurality of holes 40, 40' and 40" are provided so as to permit adjustment of the angle of first jaw 20 relative to the longitudinal extent of dipper stick 12 so as to dispose the jaw attachment 18 at an orientation particularly suited for a specific gripping operation being performed, and only one pair of the holes 40, 40' and 40" is used at a time to mount jaw 20 in dipper stick 12.

Jaw 20 has further associated therewith a second pin 50 arranged for pivotally mounting the jaw 22 as well and extending through a pair of holes 52 provided in plates 30, mating holes 54 provided in the upper end portion of plates 32, and likewise mating holes provided in the tongues 42. A conventional cotter pin 56 can be employed for retaining the shank 58 of pin 50 within the aforementioned holes. By this arrangement, it will be appreciated that jaw 20 is affixed to dipper stick 12 by means of the two spaced pivot points formed by pins 38 and 50, and jaw 22 is pivotally mounted on dipper stick 12 by means of pin 50, which latter also affectively pivotally mounts jaw 22 on jaw 20. Thus, when the jaw attachment 18 is removed from dipper stick 12, jaw 22 can be pivotally mounted on jaw 20 to form a unit therewith simply by reinserting pin 50 into the holes 52 and 54 and retaining the shank 58 of the pin within these holes by use of a cotter pin such as that designated 56.

Jaw 22 also has associated therewith a third pin 60 arranged in the pair of holes 62 provided in the plates 32 of jaw 22 and removably retained therein as by a cotter pin 64 disposed in the end of a shank 66 of pin 60 which is not provided with a retaining head. It is this pin 60 which connects link 26 to jaw 22 and, thus, permits swinging movement of jaw 22 about the pin 50 by suitable actuation of the fluid motor 16.

Each of the jaws 20 and 22 is provided with gripping portions 68 and 70, respectively, which cooperate to pickup an article, such as the illustrated railroad tie T. It will be appreciated that it is the gripping portion 70 of jaw 22 which moves relative to the gripping portion 68 of jaw 20 so as to realize the desired clamping and unclamping movements of jaw attachment 18.

Figure 6:
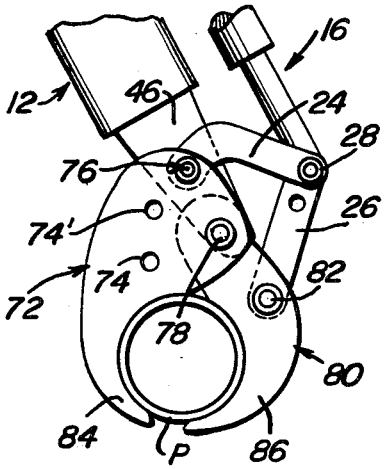
FIG. 6 is a fragmentary, side elevational view showing a second embodiment of a jaw attachment according to the present invention.
Figure 7:
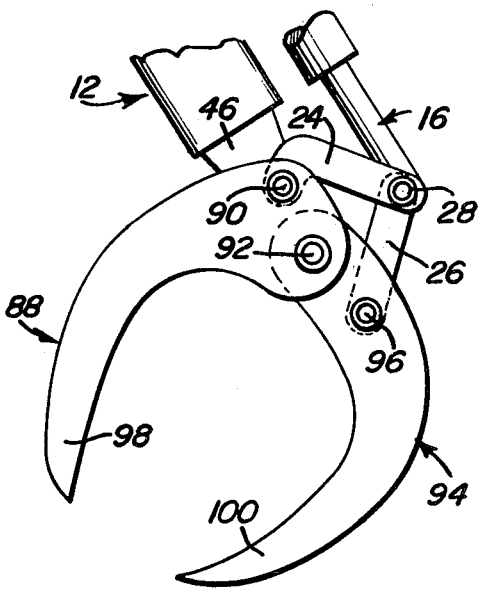
FIG. 7 is a fragmentary, side elevational view, similar to FIG. 6, but showing yet another embodiment of the invention.

Referring now more particularly to FIG. 6 of the drawings, a modified embodiment of a jaw attachment according to the invention includes a jaw 72 provided with a plurality of pairs of holes 74, 74', and a third pair of holes in which a pin 76 is illustrated as exposed. Jaw 72 is affixed to dipper stick 12 as by the use of a second pin 78, which also pivotally mounts a second jaw 80. The latter also has associated therewith a pin 82 for connection of second jaw 80 to link 26 for actuation of second jaw 80 by the motor 16. Each of the jaws 72 and 80 is provided with a gripping portion 84 and 86, respectively, provided with generally arcuate gripping surfaces for engaging the cylindrical surface of a pipe P, and the like. In a like manner, FIG. 7 shows yet another embodiment of a jaw attachment according to the invention wherein a jaw 88 is affixed to dipper stick 12 as by pins 90 and 92, and a jaw 94 is pivotally mounted on dipper stick 12 as by the latter pin 92, and also has associated therewith a third pin 96 which attaches the jaw 94 to link 26 and ultimately to the fluid motor 16. Each of the jaws 88 and 94 are provided with respective gripping portions 98 and 100 having generally elongated extents suitable for gripping brush, and the like. Thus, the operator of a backhoe need only keep a few differently configured jaw attachments according to the invention on hand in order to provide a great variety of gripping operations simply by quickly and easily interchanging one of the jaw attachments for another. In addition, only one of the stationary jaws, such as the jaw 88, need be mounted on the dipper stick 12 of a backhoe and used in conjunction with the conventional bucket (not shown) of a backhoe in order to still further enhance the versatility of a backhoe by use of the present invention.

As can be readily understood from the above description and from the drawings, a jaw attachment according to the present invention greatly increases the versatility and efficiency of a backhoe in a simple and inexpensive, yet rugged and reliable, manner which does not require the use of additional fluid motors, and the like, not already found in standard equipment on a backhoe.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. For use on a backhoe including a dipper stick, a jaw attachment comprising, in combination:

(a) a first jaw affixed to the dipper stick of the backhoe; and (b) a second jaw pivotally mounted on the dipper stick of the backhoe for movement toward and away from the first jaw, the first jaw including first pin means for mounting the first jaw on the dipper stick of the backhoe and provided with a plurality of pairs of holes arranged for receiving the first pin means, only one of the pairs of holes receiving the first pin means at a time, the plurality of pairs of holes permitting adjustment of the angle of the first jaw relative to the dipper stick, the first jaw further including second pin means for affixing the first jaw on the dipper stick in cooperation with the first pin means, and for pivotally mounting the second jaw on the dipper stick for swinging movement relative to the first jaw.

2. A structure as defined in claim 1 wherein both the first jaw and second jaw each include a pair of spaced, substantially parallel plates, with the second jaw including third pin means for facilitating attachment of the second jaw to the fluid motor associated with the dipper stick.

3. In combination with a backhoe including a mast and a dipper stick having a free end and movably pivotally mounted on the mast, and a fluid motor pivotally mounted on the dipper stick and extending toward the free end of the dipper stick, a jaw attachment, comprising, in combination:

(a) a first jaw affixed to the dipper stick at the free end thereof; and (b) a second jaw pivotally mounted on the dipper stick at the free end thereof for movement toward and away from the first jaw, the first jaw including first pin means for mounting the first jaw on the dipper stick of the backhoe and provided with a plurality of pairs of holes arranged for receiving the first pin means, only one of the pairs of holes receiving the first pin means at a time, the plurality of pairs of holes permitting adjustment of the angle of the first jaw relative to the dipper stick, the first jaw further including second pin means for affixing the first jaw on the dipper stick in cooperation with the first pin means, and for pivotally mounting the second jaw on the dipper stick for swinging movement relative to the first jaw.

4. A structure as defined in claim 3, wherein both the first jaw and second jaw each include a pair of spaced, substantially parallel plates, with the second jaw including third pin means for facilitating attachment of the second jaw to the fluid motor associated with the dipper stick.

* * * * *